US007000787B2

(12) United States Patent
Felsenthal

(10) Patent No.: US 7,000,787 B2
(45) Date of Patent: Feb. 21, 2006

(54) EXPANDABLE RACK ASSEMBLY WITH TELESCOPING TUBE SECTIONS ADAPTED TO FACILITATE CONNECTION TO SIDE SUPPORTS

(76) Inventor: Sandy A. Felsenthal, 5428 Collingwood Cove, Memphis, TN (US) 38117

( * ) Notice: Subject to any disclaimer, the term of this patent is extended or adjusted under 35 U.S.C. 154(b) by 0 days.

(21) Appl. No.: 10/360,716

(22) Filed: Feb. 10, 2003

(65) Prior Publication Data

US 2003/0209509 A1 Nov. 13, 2003

Related U.S. Application Data

(60) Provisional application No. 60/379,143, filed on May 10, 2002.

(51) Int. Cl.
*A47H 1/08* (2006.01)
*A47F 7/00* (2006.01)

(52) U.S. Cl. ..... 211/175; 211/105.3; 211/204; 211/105.4

(58) Field of Classification Search ..... 211/175, 211/189, 123, 105.1, 105.3, 105.4, 201, 204, 211/206, 105.5–105.6; 280/79.3; 248/251, 248/252, 257, 261, 264, 265, 266, 268, 269, 248/129

See application file for complete search history.

(56) References Cited

U.S. PATENT DOCUMENTS

| | | | | | |
|---|---|---|---|---|---|
| 904,229 | A | * | 11/1908 | Robinson | 16/87.4 R |
| 1,037,846 | A | * | 9/1912 | Anderson | 211/105.3 |
| 2,276,141 | A | * | 3/1942 | Atkinson | 211/37 |
| 2,492,517 | A | * | 12/1949 | Bernick | 211/123 |
| 2,532,969 | A | * | 12/1950 | Valentine | 223/92 |
| 3,249,233 | A | * | 5/1966 | Marcus et al. | 211/105.3 |
| 3,661,272 | A | * | 5/1972 | Di Panni, Jr. | 211/105.1 |
| 3,888,353 | A | * | 6/1975 | Leifheit | 211/37 |
| 4,282,977 | A | * | 8/1981 | Di Lorenzo | 211/74 |
| 4,405,111 | A | * | 9/1983 | Lennon | 248/544 |
| 4,824,302 | A | * | 4/1989 | Schultheis et al. | 410/151 |
| 4,854,456 | A | * | 8/1989 | Lee | 211/14 |
| 4,936,467 | A | * | 6/1990 | Bobeczko | 211/14 |
| D320,515 | S | * | 10/1991 | Staton | D6/411 |
| 5,385,248 | A | * | 1/1995 | Klein, Jr. | 211/105.1 |
| 5,617,959 | A | * | 4/1997 | Klein et al. | 211/37 |
| 5,660,637 | A | * | 8/1997 | Dodge | 118/500 |
| 5,803,273 | A | * | 9/1998 | Menaged et al. | 211/87.01 |
| 5,871,105 | A | * | 2/1999 | Whitehead et al. | 211/14 |
| 5,992,647 | A | * | 11/1999 | Malik | 211/34 |
| 2002/0117463 | A1 | * | 8/2002 | Daniel et al. | 211/189 |
| 2002/0148796 | A1 | * | 10/2002 | Lin | 211/105.3 |

* cited by examiner

*Primary Examiner*—Jennifer E. Novosad
(74) *Attorney, Agent, or Firm*—Breneman & Georges; Todd A. Vaughn

(57) ABSTRACT

A rack assembly has side supports with unblemished exterior surfaces because a plurality of telescoping tubes are connected between interior instead of exterior surfaces of the side supports. Since the tubes are telescoping, the rack assembly is expandable to a selected length.

6 Claims, 2 Drawing Sheets

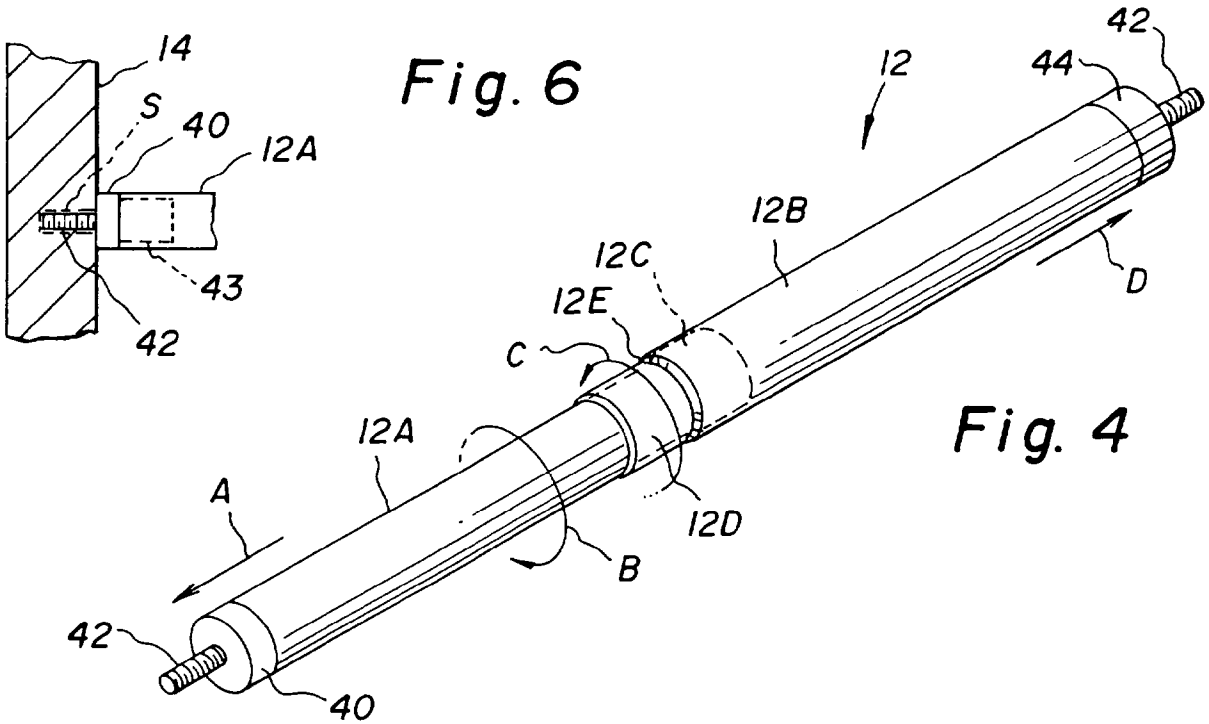
Fig. 4
Fig. 6
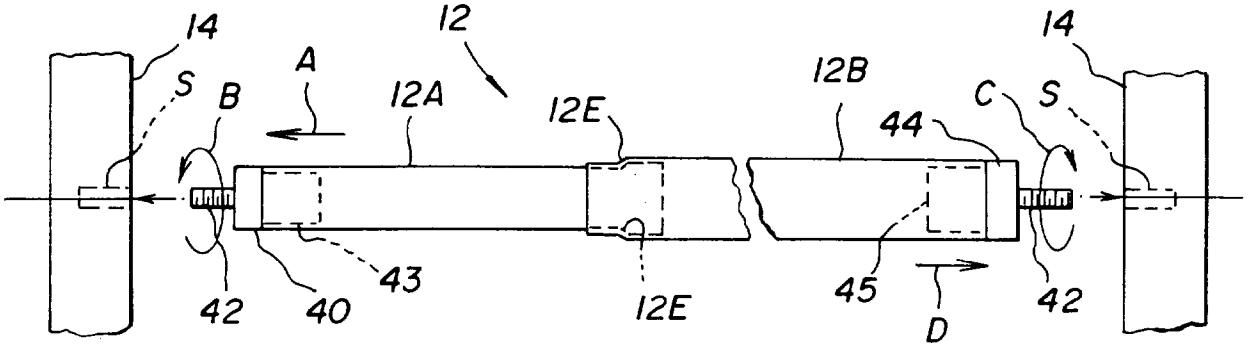
Fig. 5

EXPANDABLE RACK ASSEMBLY WITH TELESCOPING TUBE SECTIONS ADAPTED TO FACILITATE CONNECTION TO SIDE SUPPORTS

CROSS REFERENCE TO RELATED APPLICATION

This nonprovisional application claims priority from U.S. Provisional Patent Application Ser. No. 60/379,143 filed on May 10, 2002.

BACKGROUND OF THE INVENTION

1. Field of the Invention

The present invention relates generally to rack assemblies put together by an ultimate consumer and in particular to an expandable rack assembly with telescoping tube sections.

2. Description of the Prior Art

Rack assemblies of the prior art typically have hollow horizontally oriented tubes attached to vertical side supports which are usually not aesthetically pleasing because of the presence of screw holes or the protrusion of wing screw heads.

For example, in FIG. 2, there is illustrated a horizontally oriented metal tube 21 having an insert 23 with an integral head plug 25 at one end. A flat head screw 27 is threaded through a vertical side support 29 into the plug 25 so that the tube 21 is secured to the side support 29 which is typically made of plastic, metal or wood. The ultimate consumer who purchases the rack assembly must use his or her own screw driver (not shown) to thread the screw 27 through the side support 29 which is left with a plurality of unsightly holes. Also, a head H of each screw 27 will be visible in each hole, thus leaving the rack assembly with an unfinished appearance.

A second example of the prior art is illustrated in FIG. 3 into which another horizontally oriented metal tube 31 has an end cap 33. A screw 37 is threaded through a vertical side support 39 into the end cap 33 so that the tube 31 is secured to the vertical side support 39. Although the consumer does not need a screwdriver to put together this second type of rack assembly, he or she must have sufficient strength to tighten the screw 37 into the vertical side support 39 by turning a so-called wing head W. Although the vertical side support 39 is not left with a plurality of unsightly holes, it is instead left with a plurality of protruding wing heads W which are not cosmetically appealing and also which may scratch adjacent wood or metal furniture.

Thus, it remains a problem in the prior art to provide a rack assembly with a finished appearance for the side supports which will be devoid of the presence of screw holes or the protrusion of wing screw heads.

SUMMARY OF THE INVENTION

A primary object of the present invention is to provide a rack assembly with side supports having unblemished exterior surfaces which are devoid of the presence of screw holes or the protrusion of wing screw heads.

A secondary object of the present invention is to provide an expandable rack assembly with a plurality of telescoping tube sections adapted to facilitate connection to side supports which are aesthetically pleasing because they have unblemished exterior surfaces.

These objects and other advantages of the present invention will become readily apparent from a review of the accompanying drawings and a study of the following detailed description.

BRIEF DESCRIPTION OF THE DRAWINGS

FIG. 4 shows a perspective view of a telescoping tube of the present invention.

FIG. 5 shows a side elevational view of the telescoping tube being secured into two opposite side supports.

FIG. 6 shows a cross-sectional view of one end of the telescoping tube secured in one side support by an externally threaded rod.

DETAILED DESCRIPTION OF THE PREFERRED EMBODIMENT

Figure 1:
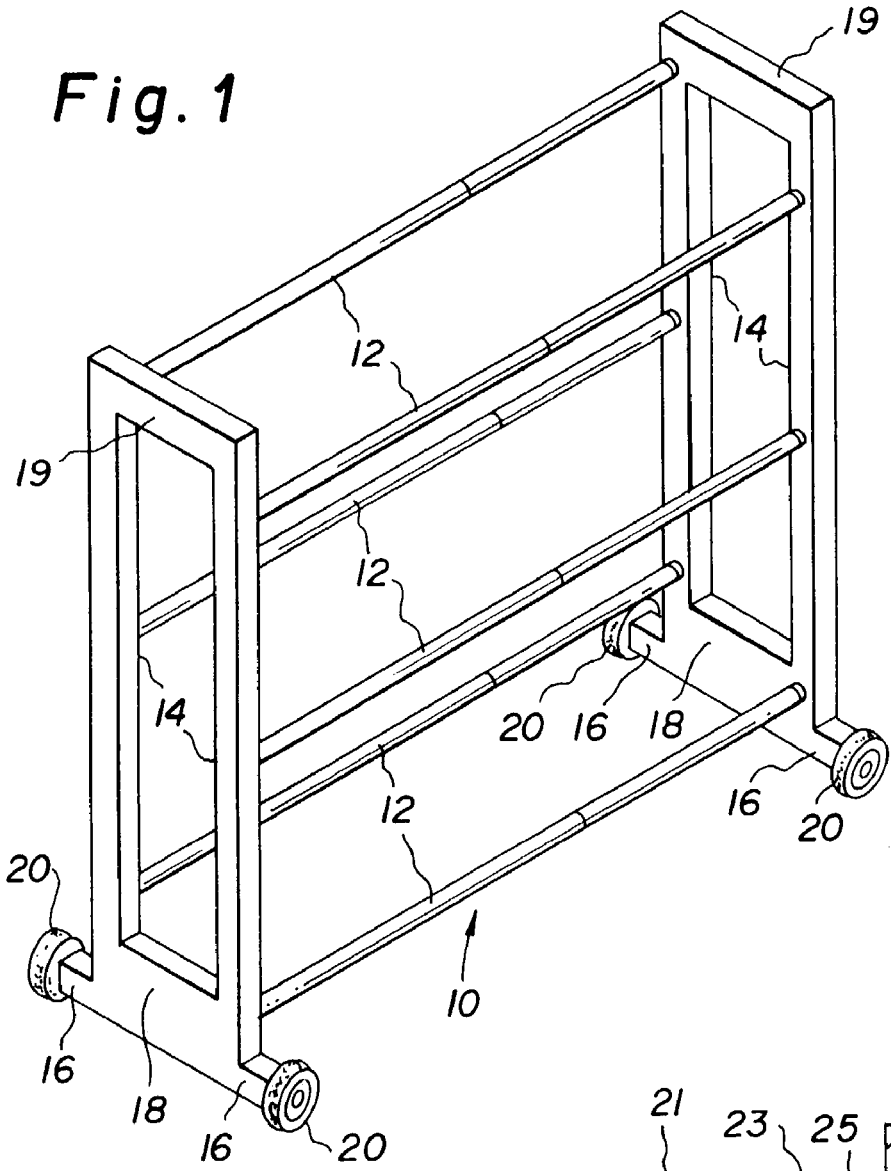
FIG. 1 shows a perspective view of a rack assembly of the present invention.
Figure 2:
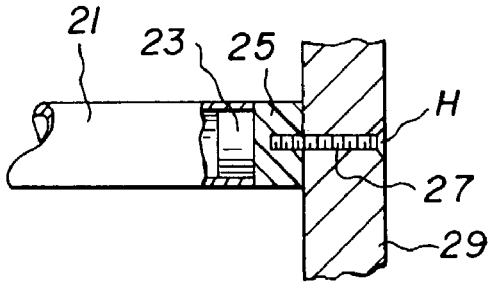
Fig. 2 PRIOR ART
FIG. 2 shows a partially broken away cross-sectional view of one example of a prior art arrangement for securing a horizontal tube to a vertical side support by a flat head screw.
Figure 3:
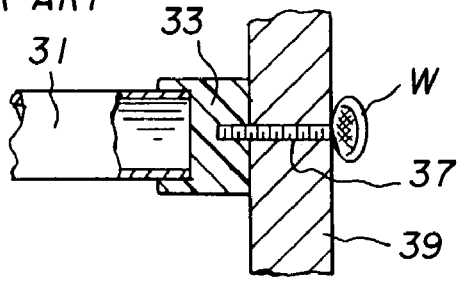
Fig. 3 PRIOR ART
FIG. 3 shows another partially broken away cross-sectional view of a second example of a prior art arrangement for securing a horizontal tube to a vertical side support by a wing head screw.

In FIG. 1, a rack assembly 10 of the present invention is expandable because a plurality of horizontally oriented telescoping metal tubes 12 are connected in a staggered arrangement to vertical side supports 14 which are aesthetically pleasing because they have smooth and clean unblemished exterior surfaces. The tubes 12 are staggered to allow shoes and the like (not shown) to be supported by the tubes 12 at inclined angles so that they may be displayed for viewing by potential buyers. The rack assembly 10 has a pair of axles 16 at a base 18 of each pair of side supports 14. A wheel 20 is attached to an end of each axle 16 so that the rack assembly 10 may be rolled from one floor area to another. A cross brace 19 connects each pair of side supports 14 at their tops. Other braces (not shown) may also connect each pair of side supports together.

In FIG. 4, a perspective view is shown of the telescoping tube 12 with an interior section 12A and an exterior section 12B. For most of its length, the interior section 12A has a smaller diameter while the exterior section 12B has a large diameter. However, a rear end 12C of the interior section 12A flares out to an intermediate diameter. Conversely, a front end 12D of the exterior section 12B tapers down to the same intermediate diameter. Thus, at a tapered transition zone 12E, the interior section 12A can extend out of but cannot escape in the leftward direction, indicated by an arrow A, from the exterior section 12B. At a front end of the interior section 12A, there is a small first plug 40 from which a first externally threaded rod 42 protrudes. At a rear end of the exterior tube 12B, there is a large second plug 44 from which a second externally threaded rod 42 protrudes.

The assembly of the telescoping tube 12 can be understood by reference to FIG. 4. First, take the exterior section 12B without the plug 44 on its rear end. Second, insert the front end of the smaller interior section 12A into the rear end of the larger exterior section 12B and allow the interior section 12A to slide in the direction of the arrow A. The exterior section 12A will continue to slide down an internal bore of the exterior section 12B until its outer transition zone 12E hits the inside transition zone 12E of the exterior section 12B. At the time of impact, the interior section 12A will stop sliding because it cannot pass any farther down the internal bore of the exterior section 12B. The small plug 40 with its rod 42 may then be placed on the front end of the interior section 12A and the large plug 44 with its rod 42 may be placed on the rear end of the exterior section 12B so that the interior section 12A cannot escape by sliding out in the rightward direction indicated by an arrow D. By twisting the interior section 12A in the direction of the arrow B and by simultaneously twisting the exterior section 12B in the direction of the arrow C, an assembler will make a snug fit between the ends 12C and 12D at the transition zone 12E of the telescoping tube 12 which is now ready for use.

In FIG. 5, use of the telescoping tube 12 is shown. Initially, the telescoping tube 12 is placed between two side supports 14, each of which has a shaft S partially pre-drilled in interior surfaces of the side supports 14. Next, the interior section 12A is slid in the direction of the arrow A while the exterior section 12B is slid in the opposite direction of the arrow D. The interior section 12A cannot pass out of the exterior section 12B because their transition zones 12E have the same intermediate diameters. A user then begins to twist the exterior section 12B in the direction of the arrow C until its externally threaded rod 42 is completely inserted into the internally threaded pre-drilled shaft S in the interior surface of the right side support 14. The rod 42 will be retained in the exterior section 12B by the plug 44 and its insert 45. Likewise, the user twists the interior section 12A in the direction of the arrow B until its externally threaded rod 42 is completely inserted into the internally threaded pre-drilled shaft S in the interior surface of the left side support 14. On this end, the rod 42 will be retained in the interior section 12A by the plug 40 and its insert 43.

FIG. 6 shows how the rod 42 is inserted into the pre-drilled shaft S in the interior surface of the side support 14 and also how the rod 42 is retained by the plug 40 and its insert 43 on the front end of the interior section 12A. The retention occurs because the plug 40 has hidden the insert 43 made of hard rubber or plastic inside the interior section 12A. This first insert 43 facilitates with or without glue a snug fit of the plug 40 onto the front end of the interior section 12A. The larger plug 44 has its similar second insert 45 hidden as seen by dashed lines in FIG. 5. The pre-drilled shaft S in FIG. 6 preferably holds an internally threaded female component which receives the externally threaded rod 42. Other devices for affixing the rod 42 in the shaft S may be employed as alternate arrangements. However, using devices with helical threading is preferred because they provide stable and readily adjustable assemblies for both engagement and disengagement.

Thus, the rack assembly 10 of FIG. 1 is expandable because the telescoping tubes 12 each have one smaller interior section 12A which slides back and forth inside one larger exterior section 12B, as best seen in FIGS. 4 and 5.

Also, as shown in FIG. 5, twisting the threaded rods 42 at opposite ends of the telescoping tube 12 provides the user with the ability to screw into the side supports 14 with great ease because both ends of the telescoping tube 12 will turn in opposite directions. In other words, after one end of the telescoping tube 12 is inserted by twisting the exterior section 12B in a clockwise direction to screw the rod 42 into the right side support 14, the interior section 12A is free to be rotated in the opposite but still clockwise direction, relative to the left side support 14, to affix the telescoping tube 12 between the two side supports 14 at a selected and desired distance.

it is advantageous for the owner to have the rack assembly 10 of FIG. 1 because it can be placed between two other pieces of furniture and adjusted in length by expanding it to a desired distance to fit completely therebetween without wasting any floor space.

Although the telescoping tubes 12 are shown to be connected to vertical side supports 14 in FIG. 1, the tubes 12 may also be connected to the cross braces 19 or to other braces (not shown) extending substantially but not necessarily horizontally between the side supports 14.

The present invention may be used not only in rack assemblies but also in other devices having the need to be expanded in length with minimal assembly. An enhanced appearance may be a significant advantage, especially in retail stores.

The invention is not limited to this specific embodiment but is made within the spirit and scope of the appended claims.

I claim:

1. A rack assembly comprising:

a. a plurality of side supports each having edge surfaces, interior front surfaces, unblemished exterior rear surfaces having no holes therein and a longitudinal hole extending partially into said interior front surfaces, said interior front surfaces being oriented in a plane substantially parallel relative to said exterior rear surfaces and also substantially perpendicular to the edge surfaces; and b. a plurality of substantially horizontally oriented telescoping tubes extending between the interior front surfaces of said side supports, said telescoping tubes including:

(i.) a first telescoping tube portion, said first telescoping tube portion having a front end of a first diameter and a rear end which flares radially outward to an intermediate diameter, said intermediate diameter being larger than said first diameter of said front end; and (ii.) a second telescoping tube portion sized to receive said first telescoping tube portion, said second telescoping tube portion having a rear end of a second diameter and a front end which tapers radially inward to said intermediate diameter to prevent said first telescoping tube section from longitudinally passing out of said second telescoping tube portion;

c. means for releasably attaching said first and second telescoping tube portions at distal ends of said front end of said first telescoping tube portion and said rear end of said second telescoping tube portion to said side supports at only said interior front surfaces, said attaching means also facilitating the adjustment of said telescoping tubes relative to said side supports through a rotation of said first telescoping tube portion and a simultaneous counter-rotation of said second tube portion relative to said rotation of said first telescoping tube portion, said attaching means including:

(i.) a first plug member sized for receipt by said front end of said first telescoping tube portion, said first plug member having at a front end thereof an externally threaded rod sized for receipt by said longitudinal hole of said interior front surfaces of said side supports, and at a rear end thereof a first insert member sized for receipt in an opening of said front end of said first telescoping tube portion to facilitate the retention of said first plug member and said externally threaded rod on said front end of said first telescoping tube portion; and (ii.) a second plug member sized for receipt by said rear end of said second telescoping tube portion, said second plug member having at a rear end thereof an externally threaded rod sized for receipt by said longitudinal hole of said interior front surfaces of said side supports, and at a front end thereof a second insert member sized for receipt in an opening of said rear end of said second telescoping tube portion to facilitate the retention of said second plug member and said externally threaded rod on said rear end of said second telescoping tube portion.

2. The rack assembly of claim 1, wherein each one of said side supports has a base portion including a pair of outwardly extending axles.

3. The rack assembly of claim 2, wherein each one of said axles is provided with a transport mechanism for facilitating the transport of said rack assembly on an underlying surface area.

4. The rack assembly of claim 3, wherein said transport mechanism comprises a wheel.

5. The rack assembly of claim 1, further comprising a longitudinal cross member for connecting each of said plurality of side supports.

6. The rack assembly of claim 1, wherein said telescoping tubes are adapted for attachment to said side supports in a staggered arrangement.

* * * * *